US007001205B2

(12) United States Patent
Godefroy et al.

(10) Patent No.: US 7,001,205 B2
(45) Date of Patent: Feb. 21, 2006

(54) ELECTRICAL CONNECTOR MODULE WITH HOUSINGS FOR RECEIVING FORWARDLY-INSERTED FEMALE CONTACTS

(75) Inventors: Alban Godefroy, Epernon (FR); Claude Casses, Clevilliers (FR); Patrice Cappe, Faverolles (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/381,996

(22) PCT Filed: Oct. 1, 2001

(86) PCT No.: PCT/EP01/11334

§ 371 (c)(1),
(2), (4) Date: Dec. 14, 2004

(87) PCT Pub. No.: WO02/29936

PCT Pub. Date: Apr. 11, 2002

(65) Prior Publication Data

US 2005/0239322 A1 Oct. 27, 2005

(30) Foreign Application Priority Data

Oct. 2, 2000 (FR) ..... 00 12538

(51) Int. Cl.
*H01R 11/20* (2006.01)

(52) U.S. Cl. ..... 439/422; 439/409; 439/733.1

(58) Field of Classification Search ..... 439/409, 439/422, 733.1, 748, 852, 752.5, 382, 856, 439/38

See application file for complete search history.

(56) References Cited

U.S. PATENT DOCUMENTS

| | | | | |
|---|---|---|---|---|
| 3,573,709 | A * | 4/1971 | Elliott | 439/748 |
| 3,853,389 | A | 12/1974 | Occhipinti | 339/217 |
| 4,317,609 | A * | 3/1982 | Lapraik | 439/733.1 |
| 5,489,221 | A * | 2/1996 | Fujiura et al. | 439/733.1 |
| 5,667,404 | A * | 9/1997 | Kato et al. | 439/578 |
| 6,146,190 | A * | 11/2000 | Fuerst et al. | 439/496 |
| 6,152,781 | A * | 11/2000 | Huang | 439/686 |

FOREIGN PATENT DOCUMENTS

| | | |
|---|---|---|
| FR | 2036751 A | 12/1970 |
| FR | 2386961 A | 11/1978 |

* cited by examiner

*Primary Examiner*—Tho D. Ta
(74) *Attorney, Agent, or Firm*—Harrington & Smith, LLP

(57) ABSTRACT

The object of the invention is an electrical connector module comprising housings (16) for receiving forwardly-inserted female contacts (18), each contact comprising a forward cage (20) and a rear blade (24) provided with pins (26) to be crimped on a flexible circuit (12). The object of the arrangement according to the present invention is to permit a forward mounting of the contact with an immobilization in its housing.

9 Claims, 3 Drawing Sheets

Figure 1:
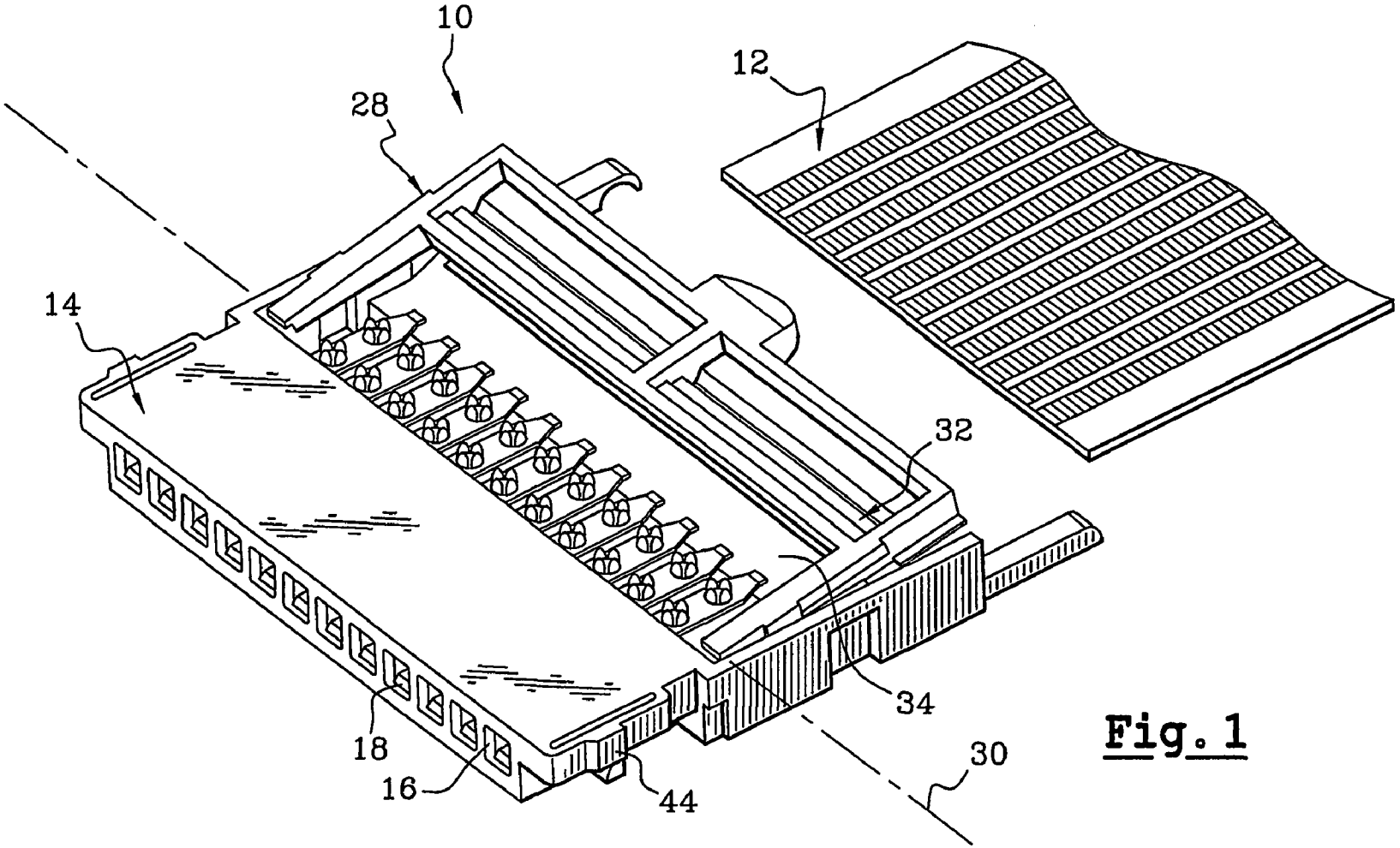

ELECTRICAL CONNECTOR MODULE WITH HOUSINGS FOR RECEIVING FORWARDLY-INSERTED FEMALE CONTACTS

The present invention concerns an electrical connector module with housings for receiving forwardly-inserted contacts. These contacts are female contacts.

This electrical connector module is also adapted to be introduced into a module-carrier.

The female contacts comprise a body with a cage at the front and a blade at the rear. This blade carries pins to be seated on the flexible circuit.

This module is equipped with a moveable flap, known generally but described according to a preferred embodiment in a related application in the name of the same applicant. Such a flap assures a mechanical blockage of the flexible circuit so as to prevent its tearing away perpendicular to the crimpings during inadvertent pulling forces exerted not only on the connector but also on the cables themselves. This flap also prevents peeling, that is to say delaminating of the sheets constituting the flexible circuit, as well as transmission of undulations via the flexible circuit, which would also tend to damage the crimpings.

During operation of the connector assembly, this flap is advantageously arranged to assume three fully-defined angular positions, one being as manufactured for insertion of the contacts, another being a delivery position for insertion of the flexible circuit into the modules, and the last, completely lowered, being closure of the flap effected simultaneously with the operation of crimping the flexible circuit on the blades of the contacts.

The flexible circuits described above, more generally designated "flex" in the connector field, are sheets formed of a complex of layers of insulating material between which are built up wiring lines of conductive material constituting both conductors and contacts for these circuits.

These conductive wiring lines are protected and electrically insulated.

Such flexible circuits are used in the case of multiple contacts to be disposed in a small clearance, and to be rejoined at the point of exit as they were upon arrival.

The width and thickness of the wiring lines determines the conductive capacity, which in turn leads to dispose, on a same flexible circuit and in a same connector, contacts of varying dimensions. Nevertheless, for purposes of simplifying the present description, the wiring lines and contacts have the same dimensions.

The numerous advantages of these flexible circuits have led designers to use them more and more, especially in the automotive industry.

In practice, the connection of the set of contacts is effected in a single operation, by crimping after insertion of the flexible circuit into the connector. Generally, locking means assure in a complementary manner the mechanical retention of the sheet in the said connector.

There remains the problem of inserting the contacts into the module and the present invention proposes an appropriate response by resorting to an arrangement which permits insertion of the contacts forwardly with a locking that prevents the retraction of each of these contacts out of their housing.

To that end, the electrical connector module comprises housings for receiving forwardly introduced contacts, and is characterized in that each housing has the shape of a truncated pyramid with a clearance angle, and in that each contact comprises bosses on the cage for immobilization and suppression of gap.

There is also provided at least one retention catch so as to assure an immobilization in the forward/reverse direction.

This module according to the present invention is also adapted to be introduced into a module-carrier, and it comprises to that end snap-locking means.

Figure 2:
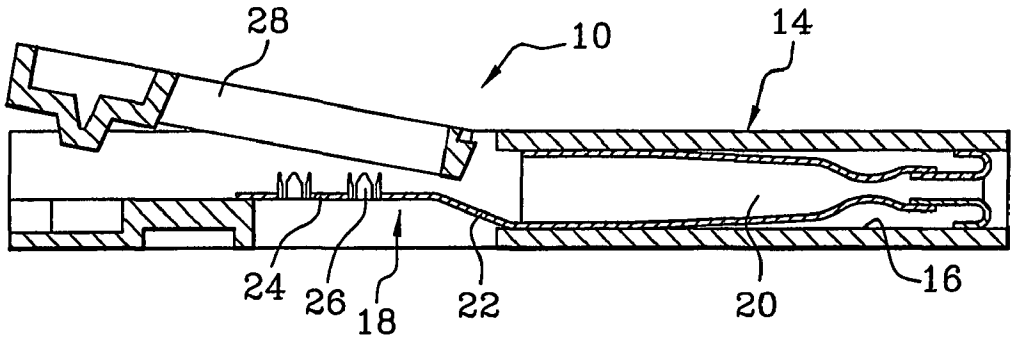
Figure 5:
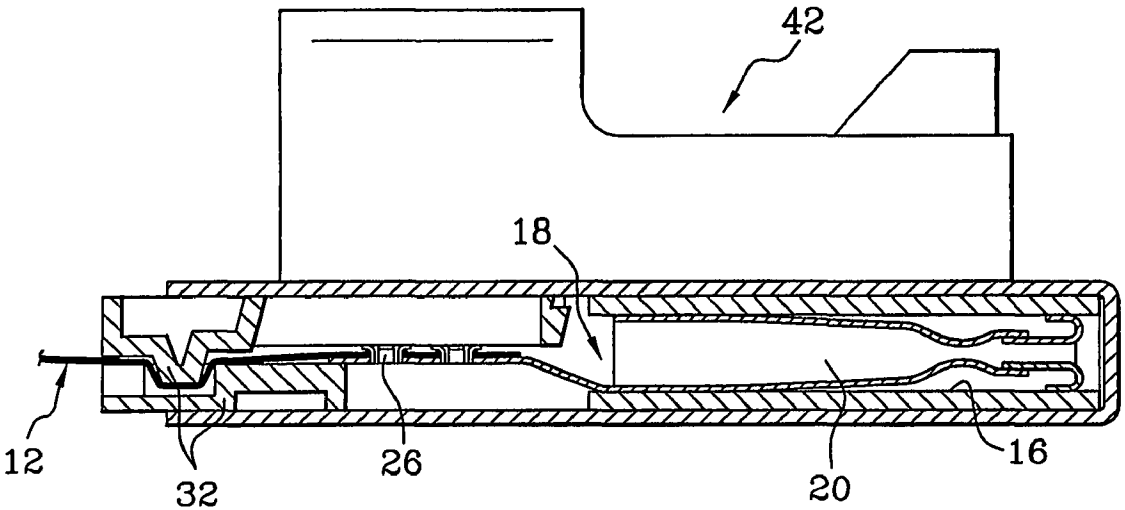
Figure 3A:
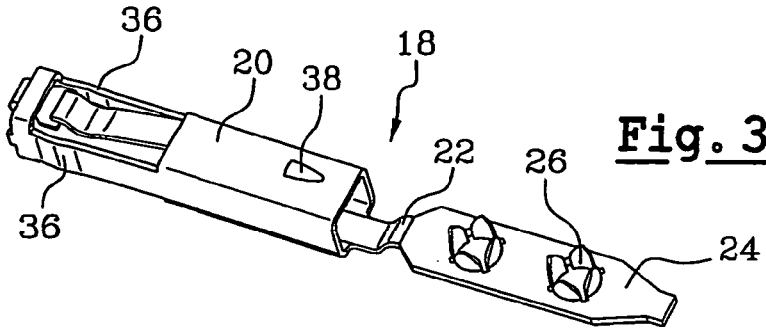
Figure 3B:
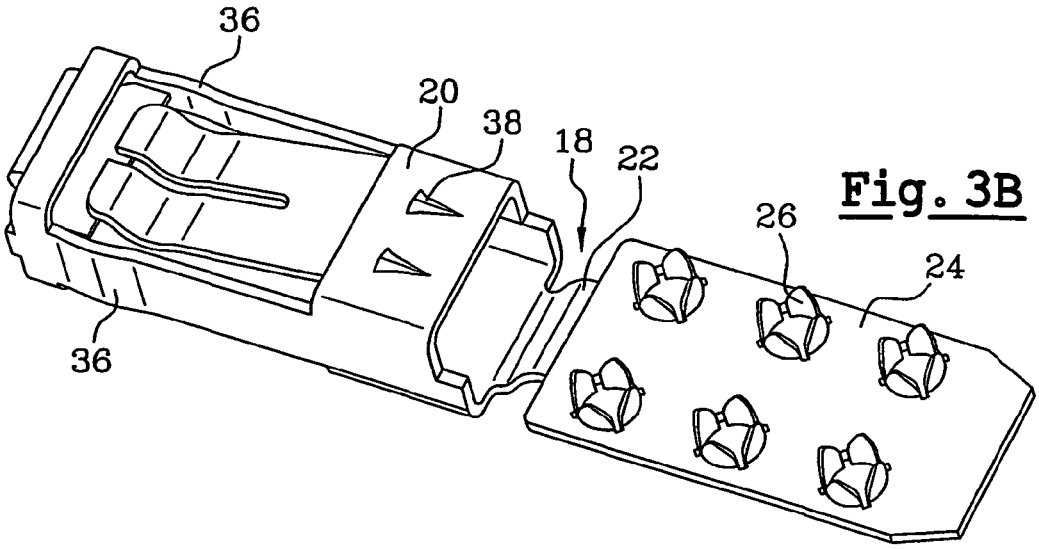
Figure 4A:
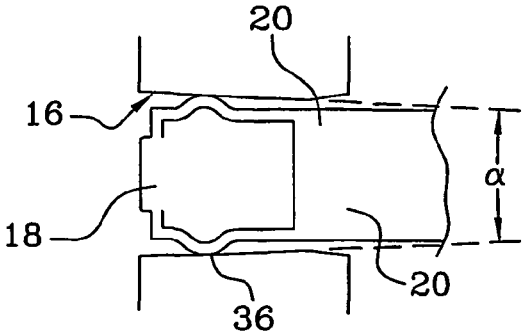
Figure 4B:
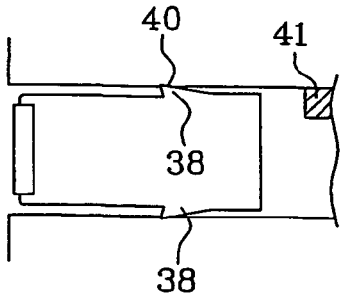

The present invention will now be described with reference to the accompanying drawings, which correspond to a preferred but non-limiting embodiment, with reference to the accompanying drawings, which show:

FIG. 1, a perspective view of an electrical connector module according to the present invention, FIG. 2, a perspective view partially broken-away of this same module, FIG. 3A, a perspective view of a contact provided with retaining means, FIG. 3B, a perspective view of a contact of greater width, FIGS. 4A and 4B, a sectional view of a housing receiving a contact provided with retaining means and a sectional view but in a perpendicular plane, and, FIG. 5, a perspective view of a module according to the present invention inserted into a module-carrier.

In FIG. 1, there is shown the contact-carrying electrical connector module 10, as well as a flexible circuit 12 about to be mounted.

The module 10 comprises a body 14 with housings 16 adapted to receive contacts 18, in this case female contacts.

Each contact 18 comprises a forward portion forming a cage 20, a transitional zone 22, and a rear blade 24, provided with pins 26 to be crimped, as is best seen in FIGS. 2, 3A and 3B.

The preferred embodiment of this module body is described in a detailed manner in a related application in the name of the same applicant.

Apart from the body 12, an important component is the means for restraining the flexible circuit, which comprise a flap 28, which pivots about an axis 30, with a tongue/groove assembly 32 adapted to generate an offset portion in the flexible circuit and to mechanically immobilize this latter upon lowering the flap. Such a position is shown in detail in FIG. 5.

It will be noted that this flap comprises a window 34 which permits assuring the criming of the pins on the flexible circuit, simultaneous to the lowering motion of the flap, through the said window. This crimping is obtained by means of a tool adapted to the type of pins, and whose manufacture is within the capability of the skilled artisan.

The problem of mounting the contacts 18 in the housing 16 is solved by characteristics of the contact and characteristics of the housing.

Specifically, the housing 16 has the shape of a truncated pyramid, with a clearance angle of slight slope, on two opposed faces among the four faces.

The large base is the inlet for connection of the housing and this housing narrows from the front to the rear.

Moreover, each cage 20 of each female contact 18 is provided with bosses 36 which come to bear on the walls in facing relation of this housing with a clearance angle as is shown in the section of FIG. 4A. Consequently, the bosses 36 are present facing and perpendicularly bearing on non-parallel walls.

Moreover, this same cage carries at least one retention catch 38, disposed in the perpendicular plane and visible in FIG. 4B. Each catch is dimensioned and disposed so as to cooperate with the wall 40 of the housing when the contact is completely inserted. In this case, the catches come into contact on the two opposing surfaces, other than those facing the bosses 36. The two surfaces receiving the catches 38 are parallel. The number of catches is variable as a function of the type of contact and for a contact of large dimensions, as shown in FIG. 3B, it is suitable to provide two pairs.

In the preferred embodiment, the catches are disposed at the rear of the cage 20, whereas the bosses are positioned forwardly.

The contact is thus immobilized, without gap, in the housing via support on the walls of this housing in the transverse direction and by coupling in the direction of forward/reverse retraction. The bosses 36 also participate in retaining the contact in its housing.

It is specifically necessary that the contact be maintained in its housing up to the crimping operation.

For the security of the retention, it is provided to dispose an abutment 41 rearwardly of each contact. The contact is lodged in the housing upstream of this abutment by the relative dimensions of the contact and of the housing. Thus, when a pulling force might be exerted on the contact, the contact is forced rearwardly into the housing up to the abutment, the resisting force being calculated to safeguard the integrity of the electrical connection until abutment occurs.

Once the module 10 is itself inserted into a module-carrier 42, it is verified that the contacts 18 also remain accessible from the front, so as to permit the connection. It is thus necessary to retain these contacts in their respective housings, at the level of the module, during disconnection or during an accidental pulling force on the module carrier.

The module and the module carrier are equipped with means 44 for snap-locking of the module into the module-carrier. In FIG. 1, only one of the two elastic locks is visible, each provided to cooperate with an opening arranged in the module-carrier.

It will also be noted that the shape with clearance angle of the housing permits generating a progressive insertion force of the contact into the housing during its positioning. Moreover, after complete insertion, each contact is force-fitted such that no gap remains, contrary to the mountings of the prior art.

There nevertheless remains a safeguard in the case of significant pulling force prior to coming in contact with the abutment 41.

In the case of a substantial pulling force, the module is forcibly extracted from the module-carrier and it is this connection which serves as the weak link to safeguard the electrical connection, even if the locking by the tongue/groove on the flexible circuit would be insufficient.

Such an arrangement permits facilitating the mounting of contacts on the one hand, while safeguarding the electrical connection even in the case of a substantial pulling force, on the other hand.

The invention claimed is:

1. Electrical connector module comprising housings each for receiving a forwardly-inserted female contact, characterized in that each female contact comprises a forward cage, wherein each cage comprises bosses for immobilizing and preventing gap, by exerting forces perpendicular to a wall of the said housing, wherein each cage carries at least one retention catch so as to assure an immobilization in the forward/reverse direction in the housing, wherein the bosses are located proximate a first end of the cage and the at least one retention catch is located proximate a second opposite end of the cage longitudinally spaced from the bosses along a length of the cage.

2. Electrical connector module comprising housings each for receiving a forwardly-inserted female contact, characterized in that each housing has the shape of a truncated pyramid with a clearance angle and in that each female contact comprises on its cage bosses for immobilizing and preventing gap, by exerting forces perpendicular to a wall of the said housing characterized in that the truncated pyramid shape of each housing is at a slight clearance angle on only two opposite surfaces which receive the immobilization bosses.

3. Electrical connector module according to claim 1, characterized in that it comprises means for snap-locking in a module-carrier.

4. Electrical connector module according to claim 1, characterized in that each housing has a contact receiving area with a shape of a truncated pyramid with a clearance angle.

5. Electrical connector module according to claim 1, characterized in that each retention catch is disposed facing parallel opposing surfaces of each housing.

6. Electrical connector module according to claim 5, characterized in that each retention catch is disposed downstream of the said contact.

7. Electrical connector module according to claim 1, characterized in that each female contact comprises in addition to the forward cage, a rear blade, provided with pins to be crimped on a flexible circuit and, and the electrical connector module further comprises means for retaining the flexible circuit when the pins are crimped on the flexible circuit.

8. Electrical connector module according to claim 7, characterized in that the retaining means comprise a flap which is pivotable about an axis with a tongue/groove assembly adapted to generate an offset portion in the flexible circuit and to immobilize the offset portion of the flexible circuit upon lowering the flap.

9. An electrical connector module comprising:

a housing having a contact receiving area;

a female contact forwardly-inserted into the contact receiving area of the housing, wherein the female contact comprises a forward cage, wherein the cage comprises bosses for immobilizing and preventing gap of the cage in the housing by exerting forces perpendicular to a wall of the housing, wherein the cage carries at least one retention catch immobilizing the cage in the housing in forward and reverse directions, wherein the bosses are located proximate a first end of the cage and the at least one retention catch is located at a second opposite end of the cage longitudinally spaced from the bosses along a length of the cage, and wherein walls of the contact receiving area contacting the bosses are angled relative to each other.

* * * * *